US005817959A

United States Patent [19]

Kagan

[11] Patent Number: 5,817,959

[45] Date of Patent: Oct. 6, 1998

[54] REVERSIBLE CARBIDE-TIPPED ENDPIN

[76] Inventor: Gerald Kagan, 3214 Oxford Ave., Bronx, N.Y. 10463-3575

[21] Appl. No.: 696,628

[22] Filed: Aug. 13, 1996

[51] Int. Cl.[6] ..... G10D 1/02

[52] U.S. Cl. ..... 84/280; 84/327

[58] Field of Search ..... 84/327, 280

[56] References Cited

U.S. PATENT DOCUMENTS 4,037,505 7/1977 Maples ..... 84/280

*Primary Examiner*—Cassandra C. Spyrou

[57] ABSTRACT

An endpin (14), primarily for the cello, comprised of a rigid rod (22) with a sharp carbide tip (18) at each end and a removable stop collar (16). The removable stop collar (16) allows for the reversal of the endpin (14). In addition, a drilled indentation (34) is used to facilitate the placement and security of the stop collar set screw (40).

3 Claims, 3 Drawing Sheets

REVERSIBLE CARBIDE-TIPPED ENDPIN

BACKGROUND

1. Field of Invention

This invention relates to the cello endpin, specifically to the tip of the endpin, which keeps the cello fixed in place on the floor when it is being played.

2. Description of Prior Art

During the last hundred or so years of its universal acceptance and use, the cello endpin has undergone few changes. The function of the cello endpin is to provide a secure support for the cello when it is being played by a performer.

Originally these endpins were wooden rods with points or rubber tips that were wedged into a socket in the bottom of the cello. These endpins were not adjustable, often fell out, sometimes were misplaced or forgotten, and were not secure on the floor.

Thereafter that type of pin was modified to include an adjustable steel rod that was held in place by a thumb screw. This was better but not adequate: the endpin could still be lost or misplaced, and the adjustable rod length was severely limited by the wooden body of the endpin.

Subsequently, inventors created a type of pin that was widely accepted by cellists: an endpin that was an adjustable rod that could be fully retracted into the bottom of the cello. This rod passes through a socket in the bottom of the cello and is held in place by a thumb screw. A rod of this type has a distinct advantage over previous types in that it cannot be lost or forgotten, and the only limit of its adjustment capability is its length. Thus, this type of endpin has virtually become the standard world wide.

However, the standard endpin has a basic exasperating flaw: the point of the tip when new is sharp, but soon after begins to blunt. When that happens, the performer finds the cello slipping or jumping away at the most inopportune or inappropriate times. That slipping or jumping of the cello during performances or practise is exasperating to every cellist; and as the pin becomes more blunted, the slipping and jumping becomes more frequent and alarming. The noise of the slip or jump is quite disconcerting to the performer and the audience. The sudden movement of the cello is usually detrimental to the performance and results in faulty passagework and shattered concentration.

So this type of endpin needs frequent sharpening, and most cellists don't have the facilities or tools or knowledge in sharpening techniques to rectify the problem, and must take the cello to someone who does. In addition, frequent sharpening brings one too close to the fixed, usually soldered stop collar, and makes further sharpening impossible. When this happens, most cellists just buy a new endpin, which is expensive.

One other type of endpin tip can be mentioned here: it is of a screw-in type with the stop collar as an integral part of the tip. It has all the flaws mentioned in the previous type; but since the tip is a screw-in type, it is less costly to replace.

Objects and Advantages

Accordingly, several objects and advantages of the present invention are:

(a) to provide an endpin with a very sharp and very longlasting tip;

(b) to provide an endpin with another very sharp and very longlasting tip at the other end of the endpin;

(c) to provide that the carbide material of each tip extends into the endpin far enough to allow a lifetime of resharpening if needed;

(d) to provide an adjustable stop collar to allow optimum resharpening angles;

(e) to further provide that the stop collar can be removed and placed on the other end of the endpin so that the endpin can be reversed; and (f) to provide an endpin that is in fact its own spare or replacement in case one tip is damaged or dulled.

These advantages are of inestimable value to every cellist. This endpin will provide cellists with peace of mind because a spare tip is immediately available in case of an emergency. It will provide a very longlasting and secure support for the cello, and thus very greatly reduce the chances that slipping and jumping of the cello will mar the performances of soloists, chamber musicians, and orchestral players.

Additionally, this endpin is easily and inexpensively manufactured, and will outlast many many endpins of the standard type now in use.

DRAWING FIGURES

In the drawings, closely related figures have the same number but different alphabetic suffixes.

FIGS. 1A, 1B, and 2 are included to clarify how the cello looks and how it is played.

Reference Numerals and Drawings

Figure 1A:
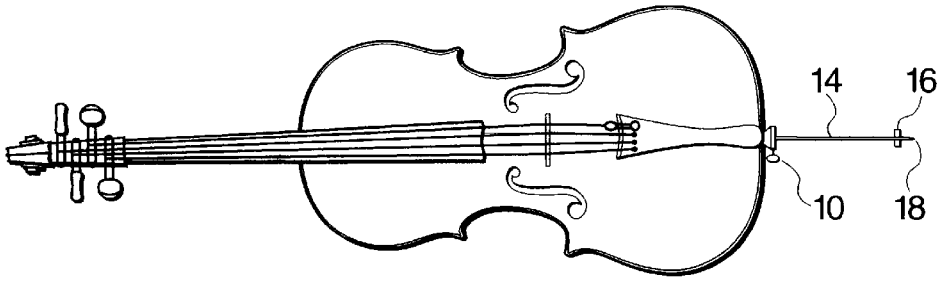

10 thumbscrew
14 endpin
16 stop collar
18 tip
22 rod
26 drilled holes
28 carbide dowel
30 sharpened carbide dowel
34 drilled indentation
38 stop collar opening
40 stop collar set screw

DESCRIPTION

Figures 3A, 3B, 3C, 3D, 3E:
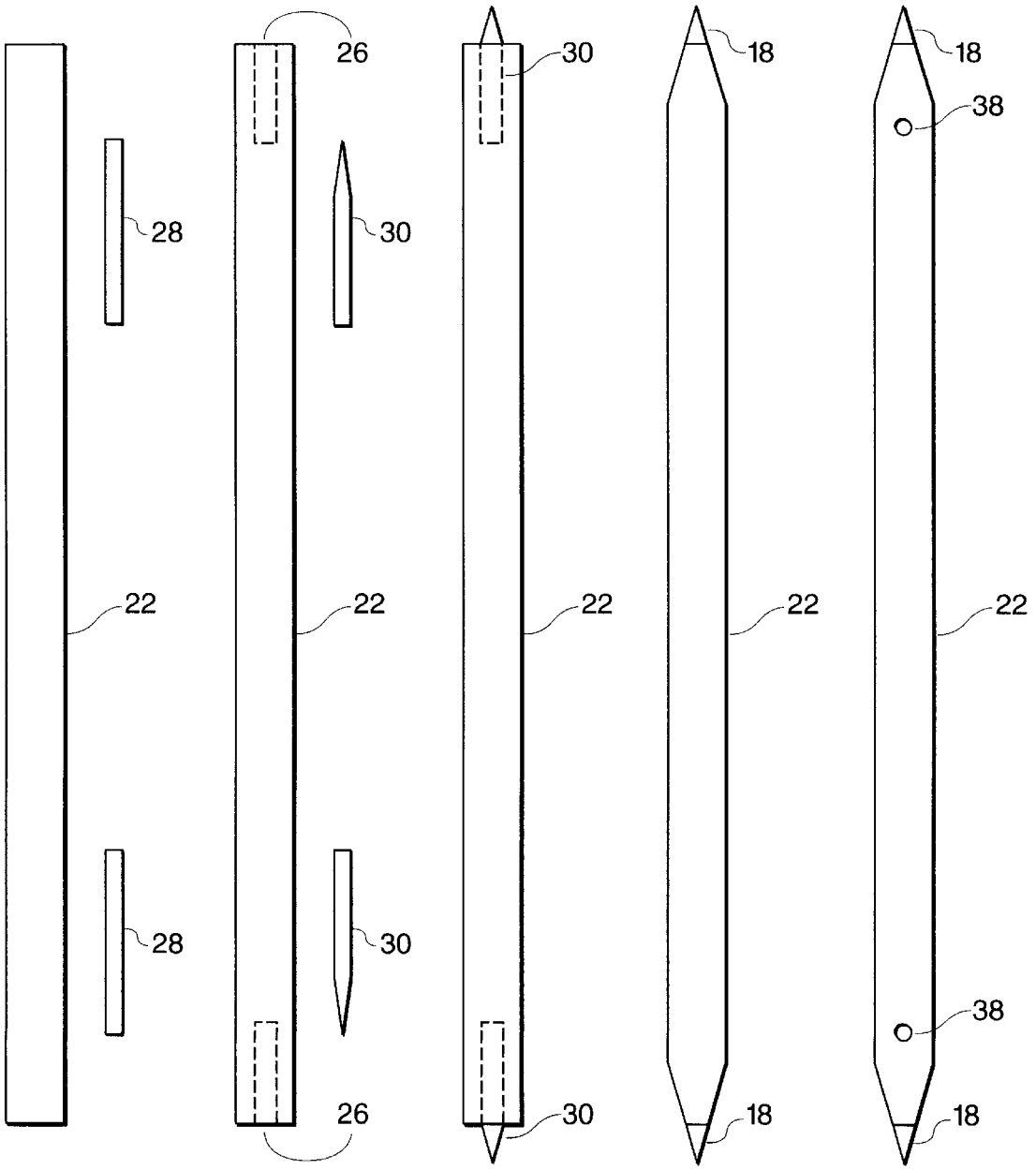
FIGS. 3A to 3E show the steps used in fabricating the endpin.
Figure 4A:
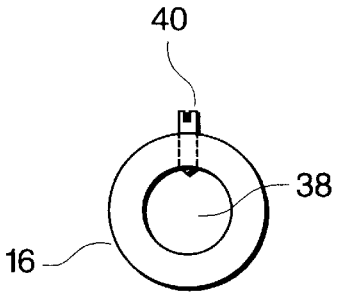
FIG. 4A shows a side view of the stop collar.
Figure 4B:
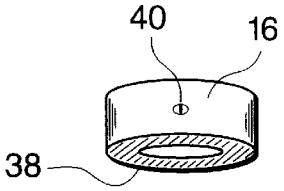
FIG. 4B shows a perspective view of the stop collar.
Figure 5A:
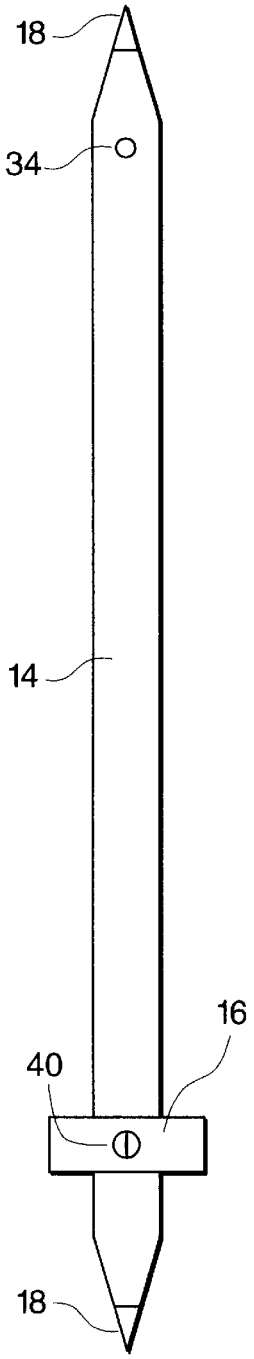
FIG. 5A shows a side view of the endpin with stop collar attached.
Figure 5B:
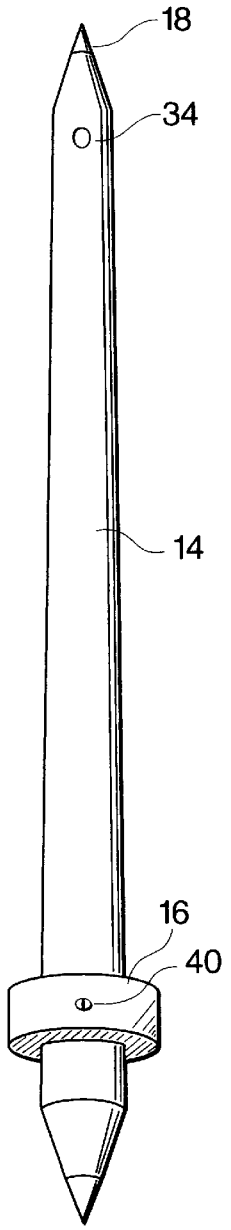
FIG. 5B shows a perspective view of the endpin with stop collar attached.

FIGS. 3 to 5

A typical embodiment of the endpin of the present invention is illustrated in FIGS. 5A (side view) and 5B (perspective view). The endpin 14 is made of a rigid material with sharp carbide inserts 30 in and extending from each end forming the sharp tips 18. The measurements in this discussion will be given to describe the most common type of endpin in worldwide use today.

The endpin 14 is fashioned from drill steel rod 22 (FIG. 3A) which is 50 cm. (20") to 60 cm. (24") with a diameter of 8 mm. (5/16"). The drill steel is available in air-hardening, water-hardening, and oil-hardening types. Since the air-hardening type is the least expensive and the three types of steel rod have similar qualities, the air-hardening is type type being used for the present discussion, as illustrated in FIG. 3A. The rod 22 is chucked into a lathe and a 3 mm. (1/8") hole 26 is drilled to a depth of 25 mm. (1") into the center of each end (FIG. 3B). The best drill for this purpose is a 3 mm. (1/8") carbide drill.

A carbide dowel 28 is turned into a sharpened carbide dowel 30 by spinning it in a lathe, and grinding one end to a sharp point with a diamond disc spinning in a hand grinder. If preferred, this grinding can be done at a later step in the manufacturing process.

Glue such as epoxy or cyanoacrylate is applied to the sharpened carbide dowel 30 and the dowel 30 is placed into the drilled hole 26 in each end of the rod 22. If glueing is not preferred, the dowel 30 can be sweat-soldered after insertion into the hole 26 (FIG. 3C). Generally, glueing is the most practical and easy method.

When the glue is set, one can spin the rod 22 in a lathe and grind it down to conform to the angle of the tip 18 (FIG. 3D).

A drill press is now used to drill an indentation 34 in the surface of the rod 22 about 25 mm. (1") from the tip 18 (FIG. 3E). At this point the rod 22 is in fact an endpin 14, and henceforth will be referred to as an endpin 14.

The stop collar is a common gadget used in many applications today. As pointed out elsewhere, in this application it is used to prevent the endpin 14 from sliding completely into the cello where it would be very difficult to retrieve. For purposes of this discussion, the stop collar 16 of endpin 14 has an 8 mm. (5/16") opening 38. The stop collar body 40 has an outside diameter of 16 mm. (5/8") and is 8 mm. (5/16") thick.

From the description above, a number of advantages of my reversible carbide-tipped endpin becomes evident:

(a) This endpin can be manufactured quickly out of inexpensive and readily available materials.

(b) To machine this endpin requires no more sophisticated equipment than a lathe, handgrinder, drill press, and common hand tools.

(c) The inlaid carbide tip can be made very sharp because of the extreme hardness of the carbide.

(d) Slippage of the endpin is virtually eliminated by the very long-lasting sharpness of the tip.

(e) Variation in the materials, design, and ornamentation of the stop collar will lead to artistic creativity in its design.

(f) Resharpening of the tip can be done at the convenience of the cellist because of the very long-lasting tip at the other end of the endpin.

(g) The carbide tip is not plagued by the common steel tip defect, namely, that if a steel tip is made too sharp, it will bend or dull even more quickly.

OPERATION

FIGS. 1A, 1B, 2, 4, 5

Figure 1B:
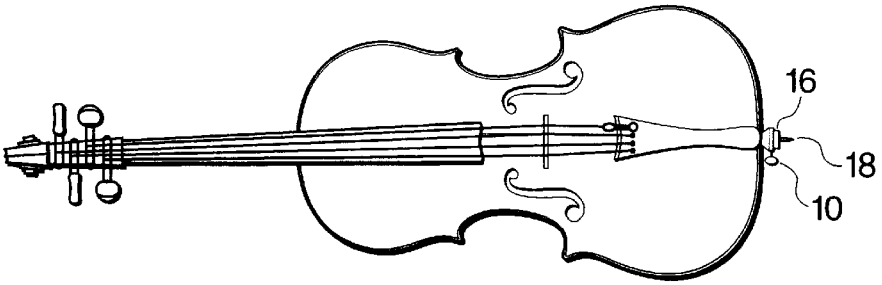
Figure 2:
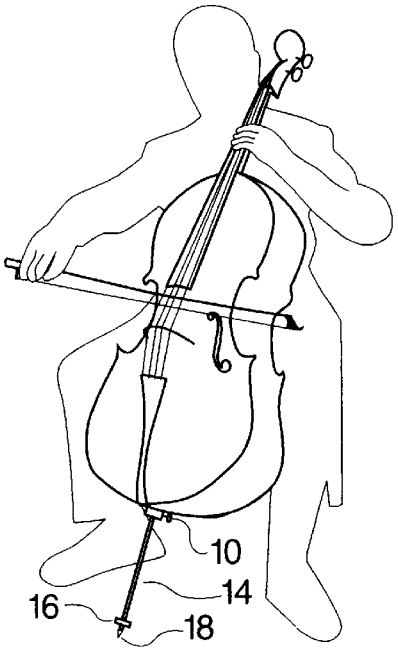

The thumbscrew 10 is loosened enough to allow insertion of the endpin 14 into the hole in the bottom of the cello (FIGS. 1A and 1B). The endpin 14 is then adjusted to any length desired by the cellist and the thumbscrew 10 is tightened. The tip 18 of the endpin 14 is placed on the floor, and the cellist is ready to play (FIG. 2). When the cellist is finished playing, the thumbscrew 10 is loosened and the end pin 14 is retracted into the cello (FIG. 1B), and the cello is placed into its case. Thus the endpin 14 is always in the cello except when removed for resharpening or reversal. To reverse the endpin 14, it is removed from the cello after loosening the thumbscrew 10. The set screw 40 of the stop collar 16 is loosened, and the stop collar 16 is placed on the appropriate place of the other end where the set screw 40 is retightened. The endpin 14 is placed into the hole in the bottom of the cello and the thumbscrew 10 is tightened.

SUMMARY, RAMIFICATIONS, AND SCOPE

Accordingly, the reader will see that this invention is a relatively inexpensive and simple solution to one of the most perplexing, annoying, and embarrassing problems of contemporary cellists. An ordinary endpin begins to dull and consequently to slip sometimes in as little as a few weeks after sharpening. The carbide-tipped endpin can remain sharp enough for use for years. Furthermore, the reversible carbide-tipped endpin has the additional advantage in that it is readibly reversible by simply removing the stop collar and reversing the endpin, thus insuring that the cellist has a readily available replacement;

it can be used as original equipment or as replacement;

it provides an extra incalculable emotional measure of security to the performer who knows that the cello is firmly anchored to the floor;

it can easily be resharpened; and it can provide a lifetime of reliable service.

Although the description above provides many specificities, these should not be construed as limiting the scope of the invention, but as merely providing illustrations of some of the presently preferred embodiments of this invention. For example, instead of plain steel, the endpin can be chrome plated, gold plated, brass plated, or made of other materials like brass, aluminum, carbon fiber, fiberglass, and so on. The stop collar can be made of any of the above materials, and also shaped or decorated in some way: knurling, milling, engraving, or polygonal shaping of the outer ring—hexagonal, octagonal, free form, and so on. In addition, this endpin can be adapted to be used in any other instrument requiring an endpin, such as the double bass.

Thus the scope of the invention should be determined by the appended claims and their legal equivalents, rather than by the examples given.

I claim:

1. An end pin for supporting a musical instrument on a support surface comprising:

a rod having a first end and an opposite second end;

a means for anchoring the musical instrument to the support surface provided at each of said first and second ends of the rod; each of said means for anchoring the support surface comprising a sharp carbide tip;

a stop collar positioned along the length of the rod including means for releasably securing the collar to the rod.

2. The end pin according to claim 1 wherein:

a hole is located within each of said first and second ends of said rod; and, each of said means for anchoring includes a carbide insert having said sharp carbide tip; said inserts being positioned within a respective one of said holes.

3. An end pin comprising:

a rod having a first end and an opposite second end;

a hole located within each of the first and second ends of the rod;

a carbide insert positioned within and extending from each of said holes; said insert including a sharp carbide tip;

a stop collar positioned along the length of the rod including means for releasably securing the collar to the rod.

* * * * *